US007690285B2

(12) United States Patent
de Buyer

(10) Patent No.: US 7,690,285 B2
(45) Date of Patent: Apr. 6, 2010

(54) MANUAL SAFETY VEGETABLE CUTTER

(76) Inventor: Julien de Buyer, BP 2 Faymont, Le Val d'Ajol (FR) 88340

( * ) Notice: Subject to any disclaimer, the term of this patent is extended or adjusted under 35 U.S.C. 154(b) by 608 days.

(21) Appl. No.: 11/010,585

(22) Filed: Dec. 13, 2004

(65) Prior Publication Data

US 2006/0081108 A1 Apr. 20, 2006

(30) Foreign Application Priority Data

Oct. 15, 2004 (FR) ..... 04 10911

(51) Int. Cl.
*B26D 3/26* (2006.01)
*B26D 1/02* (2006.01)
*B26D 3/00* (2006.01)

(52) U.S. Cl. ..... 83/247; 83/856; 83/932; 99/537

(58) Field of Classification Search ..... 83/703–704, 83/707–708, 422, 431, 717, 718, 435.12, 83/435.15, 437.7, 657, 441.1, 554, 856–858, 83/932, 852, 247, 425.3, 698.11, 652; D7/672, D7/673, 678; 99/537; 30/278, 280, 279.6, 30/283, 286, 287, 289–291; 269/67, 69, 269/72, 309; 248/37.3; 241/273.1; 292/80
See application file for complete search history.

(56) References Cited

U.S. PATENT DOCUMENTS 4,038,892 A * 8/1977 Popeil ..... 83/717
4,150,464 A * 4/1979 Tracy ..... 24/313
4,212,431 A * 7/1980 Doyel ..... 83/857
4,570,519 A * 2/1986 Motosko, II ..... 83/856
4,573,387 A * 3/1986 Denter et al. ..... 83/856
4,624,166 A * 11/1986 Kreth et al. ..... 83/856
4,733,588 A * 3/1988 Yamamoto ..... 83/857
4,871,329 A * 10/1989 Van Der Meer ..... 292/80
5,123,167 A * 6/1992 Kelley ..... 30/151
5,577,779 A * 11/1996 Dangel ..... 292/80
5,743,606 A * 4/1998 Scholder ..... 292/80
5,745,999 A 5/1998 Zirkiev ..... 30/278
6,805,044 B1 * 10/2004 Yamamoto ..... 99/537
D503,314 S * 3/2005 Wong ..... D7/673

(Continued)

FOREIGN PATENT DOCUMENTS

FR 2 825 043 5/2001

OTHER PUBLICATIONS

Chef'S®, Holiday 2005, pp. 21, 62, and 63.*

*Primary Examiner*—Jason Daniel Prone
(74) *Attorney, Agent, or Firm*—Drinker Biddle & Reath LLP

(57) ABSTRACT

One embodiment of a manual safety vegetable cutter has a frame which is supported on feet and which is provided with two parallel longitudinal uprights. The uprights define two guiding rails for a carriage which can be moved back and forth in translation and which are connected by means of a plate for adjusting the cutting width. At least one cutting blade is mounted transversely between the longitudinal uprights. The vegetable cutter is provided with at least one removable disc-cutting cartridge which can be inserted longitudinally between the uprights of the frame and which comprises a first edge, on which the cutting blade is mounted This disc-cutting cartridge is provided with gripping elements which co-operate with positioning elements provided on the frame.

17 Claims, 6 Drawing Sheets

U.S. PATENT DOCUMENTS

Figure 1:
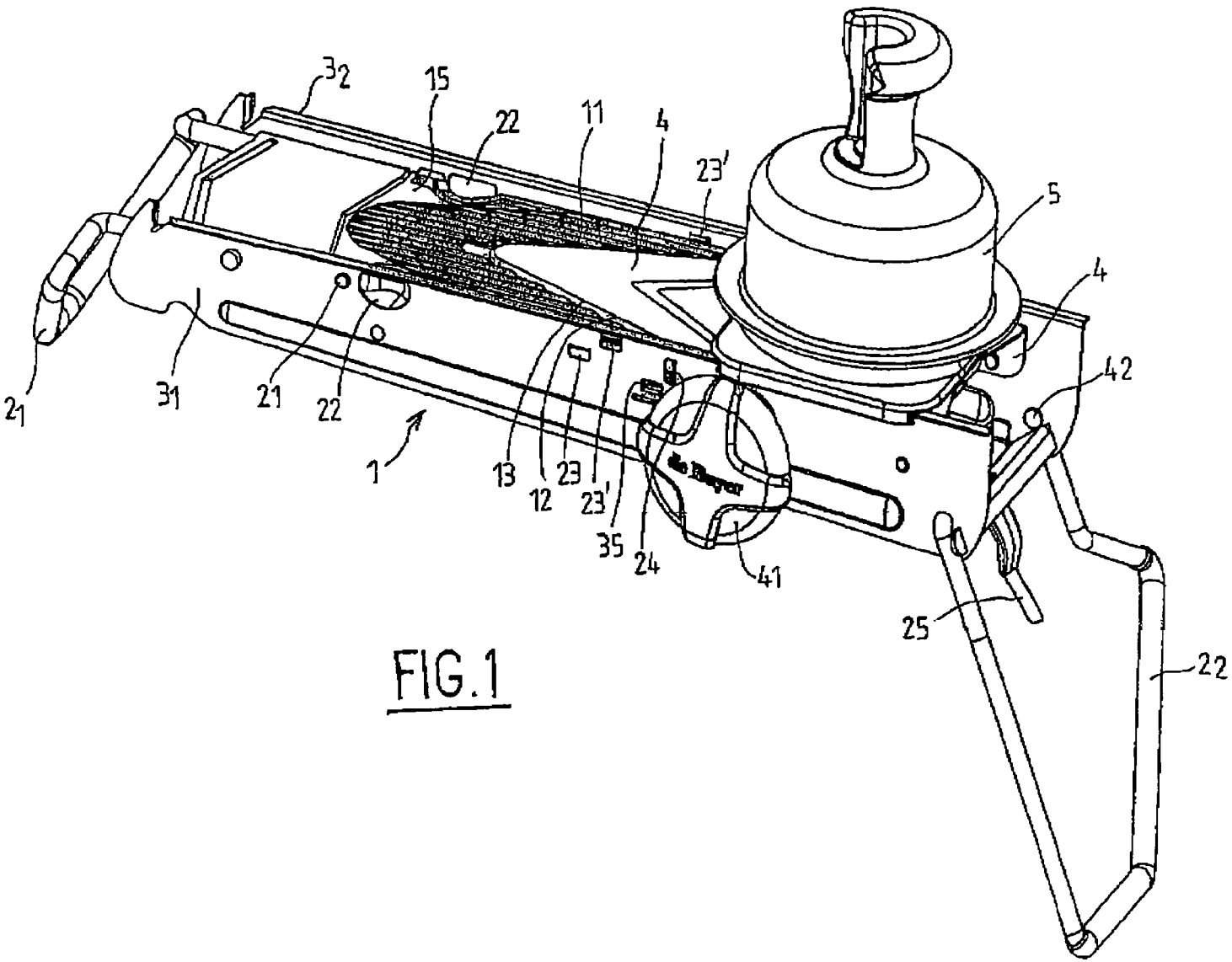

| | | | | | |
|---|---|---|---|---|---|
| D534,041 | S | * | 12/2006 | De Buyer | D7/673 |
| D535,162 | S | * | 1/2007 | De Buyer | D7/673 |
| D535,163 | S | * | 1/2007 | De Buyer | D7/673 |
| D535,533 | S | * | 1/2007 | De Buyer | D7/673 |
| D590,208 | S | * | 4/2009 | de Buyer | D7/412 |
| D596,467 | S | * | 7/2009 | de Buyer | D7/693 |
| D599,618 | S | * | 9/2009 | de Buyer | D7/412 |
| 2002/0174754 | A1 | * | 11/2002 | Vincent | 83/857 |
| 2005/0028685 | A1 | * | 2/2005 | Yamamoto | 99/537 |
| 2005/0229768 | A1 | * | 10/2005 | Buyer et al. | 83/856 |
| 2006/0075872 | A1 | * | 4/2006 | Wangler | 83/856 |
| 2006/0081108 | A1 | * | 4/2006 | de Buyer | 83/703 |
| 2007/0144326 | A1 | * | 6/2007 | de Buyer | 83/932 |
| 2009/0133587 | A1 | * | 5/2009 | de Buyer | 99/537 |

* cited by examiner

MANUAL SAFETY VEGETABLE CUTTER

BACKGROUND OF THE INVENTION

1. Field of the Invention

The present invention relates to a manual safety vegetable cutter for both domestic and professional use.

According to the invention, the word "vegetables" should be understood in a very broad sense and the vegetables which are cut may be not only any type of vegetable in the strict sense, but also fruit or other foods suitable for being cut.

2. Description of Related Art

There are currently on the market various types of manual vegetable cutter which have in common that they are not very practical and expose their users to serious risks of cuts to the hands.

At the same time, there are also many vegetable cutters or electric food processors of a versatile nature intended for domestic use or for industries or collectives.

As a general rule, however, these are sophisticated appliances which, in addition to their high cost, often have the disadvantage of being inconvenient to use and also difficult to clean.

In order to overcome this disadvantage, in accordance with the document FR 2 825 043, a simple, practical and inexpensive manual vegetable cutter has been proposed which enables the cutting characteristics to be varied selectively.

This known device, which is referred to by experts as a "slicer" comprises:

a frame which is supported on feet, which can preferably be folded up, and which is provided with two parallel longitudinal uprights which define, on the one hand, two guiding rails for a carriage which can be moved back and forth in translation and which delimits, at the inner portion thereof, a space for receiving vegetables to be cut, and which are portion thereof, a space for receiving vegetables to be cut, and which are connected, on the other hand, by means of a plate which is mounted so as to be moveable in translation between these uprights, perpendicularly to the displacement axis of the carriage in order to allow the cutting width to be adjusted, and at least one cutting blade which is mounted transversely between the longitudinal uprights facing an edge or first edge of the plate for adjusting the cutting width in order to define an aperture for the passage of the cut vegetables.

In a vegetable cutter of this type known from the prior art, the carriage is constituted, on the one hand, by a cylindrical guide chamber which is open at the upper portion thereof and which is provided, at the lower portion thereof, with a substantially rectangular collar, two of the opposing edges of which are folded down in order to define two grooves which co-operate with the guiding rails and, on the other hand, by a push-button which fits on or in the guide chamber and which is intended to be gripped manually by the user in order to move the carriage along the guiding rails with a pressure being applied continuously to the vegetables which are contained in the receiving space in order to press them against the cutting blade and allow them to be cut by this blade.

This safety vegetable cutter has the advantage of enabling many different types of preparation to be readily performed (smooth or corrugated discs, crinkle-cutting, dicing, . . . ) and has therefore been very well received by users.

It also has many other advantages which are connected, in particular, to its compactness for storage, and also its easy maintenance, particularly using a dishwasher.

However, it has been found from experience that the adjusting system for the cutting blades can be difficult to manipulate and may also expose users to cutting risks.

BRIEF SUMMARY OF THE INVENTION

The object of the present invention is therefore to improve a known vegetable cutter of this type according to the prior art.

To this end, the invention relates to a manual safety vegetable cutter of the above-mentioned type, characterised in that it is provided with at least one disc-cutting cartridge constituted by a substantially flat removable element which can be inserted longitudinally between the uprights of the frame and which comprises a first edge, on which the cutting blade is mounted, a second edge facing the first, as well as two lateral edges, this disc-cutting cartridge being provided with gripping means which co-operate with positioning means which are provided on the frame.

This manual safety vegetable cutter is therefore distinguished substantially from the known vegetable cutter in that the cutting blade is mounted on a disc-cutting cartridge which is intended to be inserted, not transversely but longitudinally, between the uprights of the frame, which is found to be more practical and less dangerous for the user.

According to the invention, the positioning means preferably comprise, on the one hand, at least two pairs of longitudinal lugs which are located facing each other on the inner face of each respective upright in order to define guiding slides for the lateral edges of the disc-cutting cartridge, close to the first edge thereof which is provided with the cutting blade, and which co-operate with a pair of transverse lugs which form a stop for this first edge and, on the other hand, elements for retaining the disc-cutting cartridge in the region of the second edge thereof.

In order to position the cartridge, the user therefore only has to grip the cartridge and then insert it into the guiding slides and move it in longitudinal translation until it comes into abutment.

The elements for retaining the disc-cutting cartridge in the region of the second edge thereof can themselves simply be constituted by one or more support stop(s) which is/are provided on a fixed element of the frame in the central portion thereof, or at one side and the other on the longitudinal uprights, and on which the disc-cutting cartridge is supported.

The elements for retaining this cartridge are, however, preferably constituted by two resiliently deformable hooks which are located facing each other on the respective lateral edges thereof and which are each provided with a retaining stud which can be snapped into holes which are drilled for this purpose in the uprights of the frame.

According to another feature of the invention, the gripping means are constituted by two safety notches which are located facing each other on the respective lateral edges of the disc-cutting cartridge, close to the second edge of this cartridge.

These notches can advantageously co-operate with finger holes which are provided in the longitudinal uprights of the frame in order to facilitate the positioning of the disc-cutting cartridge.

These safety notches can also advantageously be provided in the region of the resiliently deformable hooks located facing each other on the respective lateral edges of the disc-cutting cartridge in order to facilitate the gripping of this cartridge.

According to a preferred feature of the invention, the cutting blade mounted on the first edge of the disc-cutting cartridge is a V-shaped blade.

The advantage of a blade of this type is to be able to provide knives which are capable of gripping the vegetables to be cut at both sides, which is preferable in the case of relatively soft vegetables, and in particular tomatoes, which are difficult to cut with a straight blade since they have a tough skin and soft flesh.

This V-shaped cutting blade can further advantageously be corrugated in order to allow corrugated discs of variable width to be cut, or even cutting of the "crinkle" type, if the push-button which fits in or on the guide chamber is rotated by 180° with each back and forth movement of the carriage.

A blade of this type in particular allows tomatoes to be crinkle-cut which was previously impossible.

According to another preferred feature of the invention, the vegetable cutter is also provided with at least one removable baton-cutting cartridge or julienne cartridge which can be inserted longitudinally between the uprights of the frame below the disc-cutting cartridge and which comprises an active face which is provided with a series of longitudinal-cutting blades which are directed transversely and which are intended to be positioned facing this cartridge.

This julienne cartridge is therefore also inserted longitudinally between the uprights of the frame, in the same manner as the disc-cutting cartridge but in the lower portion of the plate for adjusting the cutting width.

To this end, the julienne cartridge can advantageously be provided with a positioning tongue which facilitates the positioning thereof and which further allows the longitudinal-cutting blades to be protected.

It should be noted that, in the context of this description, the terms lower and upper or below and above must be understood with the vegetable cutter being considered in a position for use resting on a horizontal support, whilst the term front corresponds, still in this position, to the lowest end of the frame and the term rear to the highest end thereof.

According to the invention, the julienne cartridge can advantageously be constituted by a substantially triangular element which comprises, on the one hand, a first edge which is located facing the first edge of the plate for adjusting the cutting width and which is intended to abut plates which are mounted for this purpose between the uprights of the frame and to be locked in position by a slide which can be moved in apertures of these uprights and, on the other hand, two lateral edges which are separated by a positioning peak which is provided, in the region of the edge thereof, with a recess which is intended to be inserted in a central shoulder of a transverse centering bar which separates the two uprights of the frame.

Given this configuration, the julienne cartridge can be mounted on the frame between the lateral uprights thereof in as simple and rapid a manner as the disc-cutting cartridge.

According to the invention, it was found that cutting was more straightforward if the plate for adjusting the cutting width and the cutting cartridges were inclined at an angle of approximately 45° relative to the longitudinal axis thereof.

Consequently, and according to a particularly advantageous feature of the invention, the feet of the frame of the vegetable cutter have a shape which allows such an inclination to be achieved.

This shape is preferably selected so that the vegetable cutter can be handled both in a straight position and in an inclined position.

It has been found to be advantageous to shape the front foot in a symmetrical manner and the rear foot in an asymmetrical manner.

The rear foot can also advantageously be introduced into holes of the uprights of the frame with force in order to be able to be positioned in one direction or the other so that the vegetable cutter can be operated by either a right-handed or a left-handed user.

During the cutting operation, the user can advantageously press on an ergonomically shaped lateral handle which is fixed to the elements for adjusting the cutting width.

According to another feature of the invention, the vegetable cutter is provided with a crank for micrometric adjustment of the cutting width.

The features of the safety vegetable cutter which is the subject-matter of the invention will be described in greater detail with reference to the appended drawings, in which:

BRIEF DESCRIPTION OF THE DRAW1NGS

Figure 2:
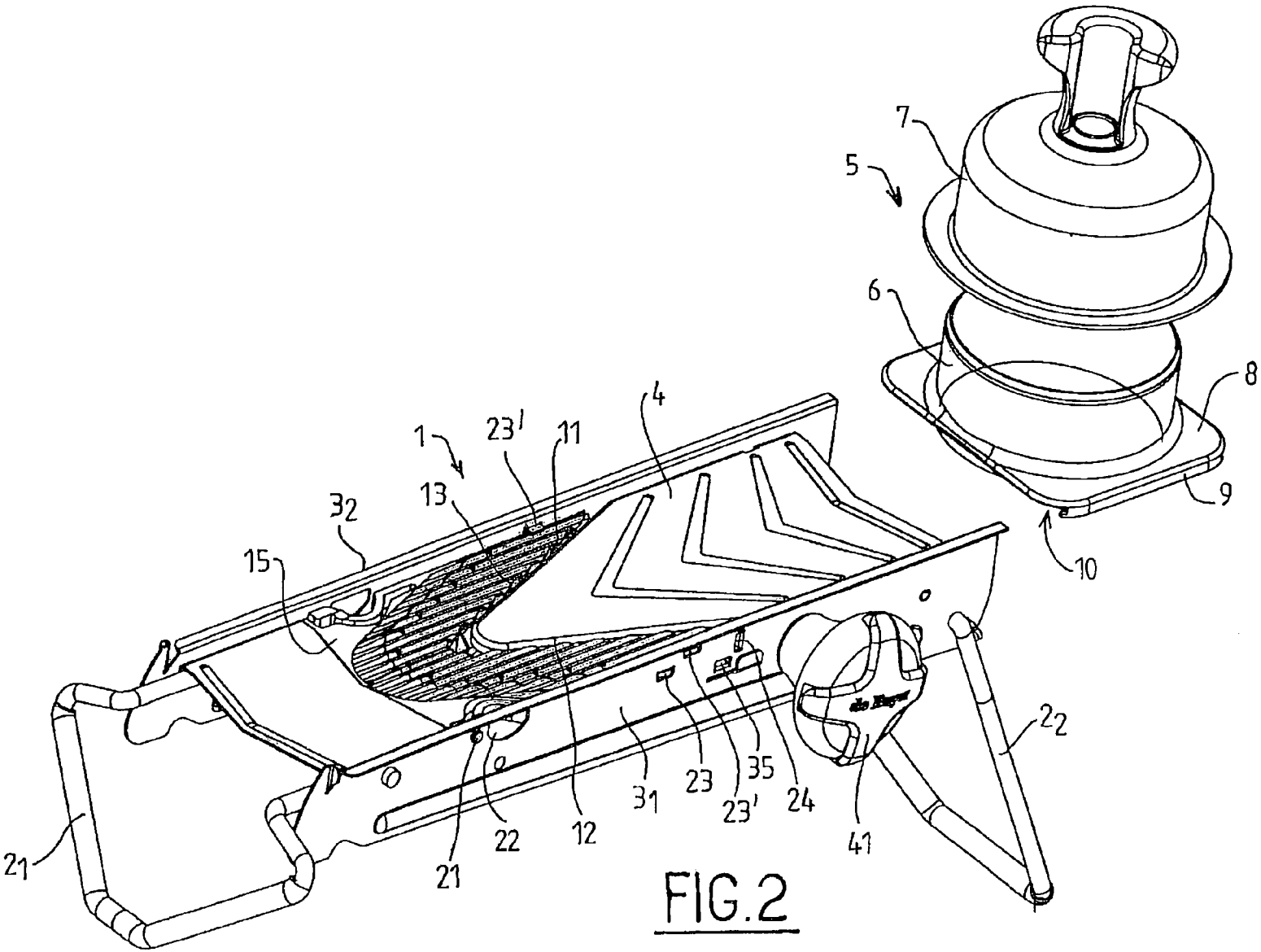
Figure 3:
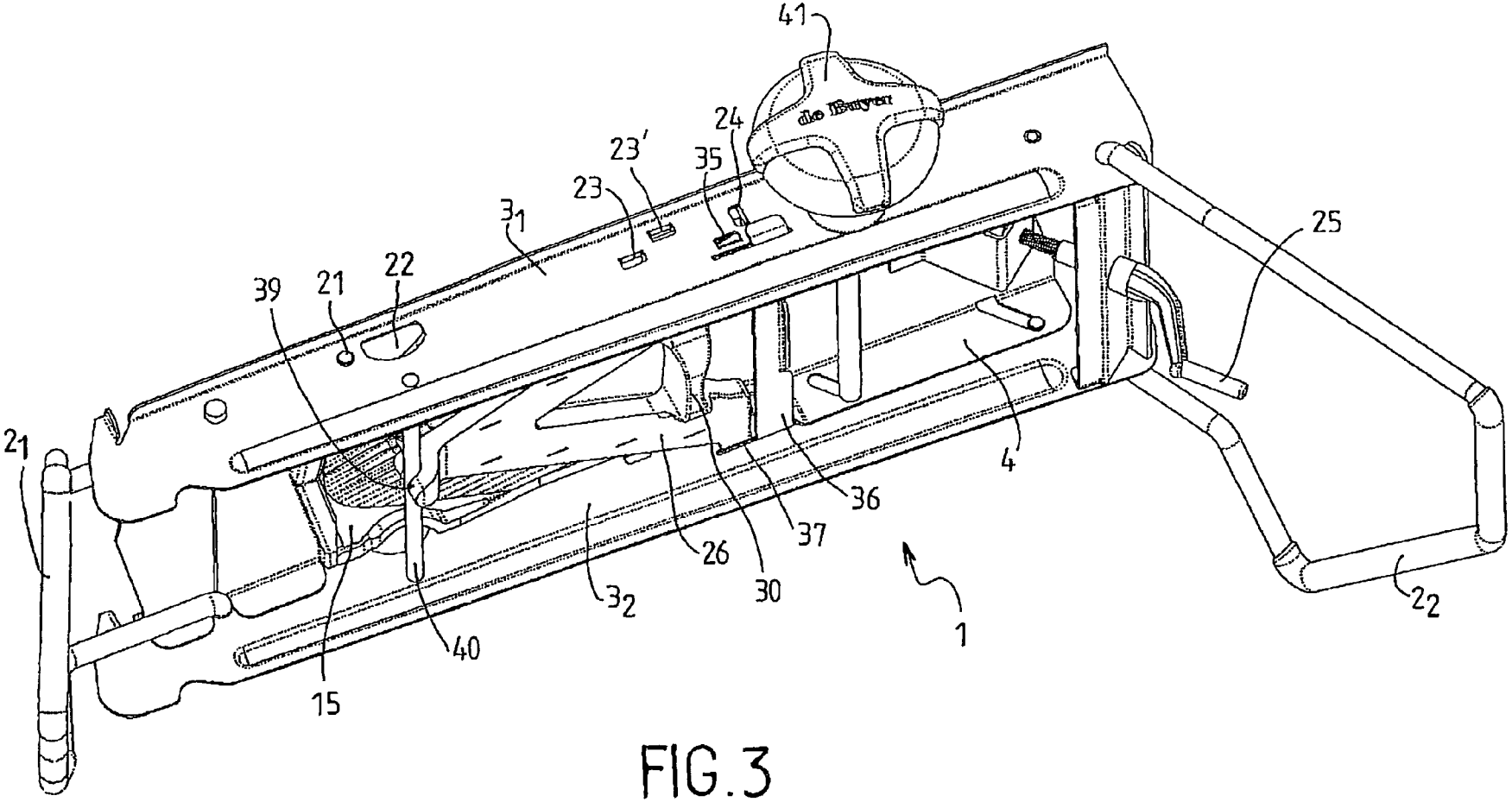
Figure 4:
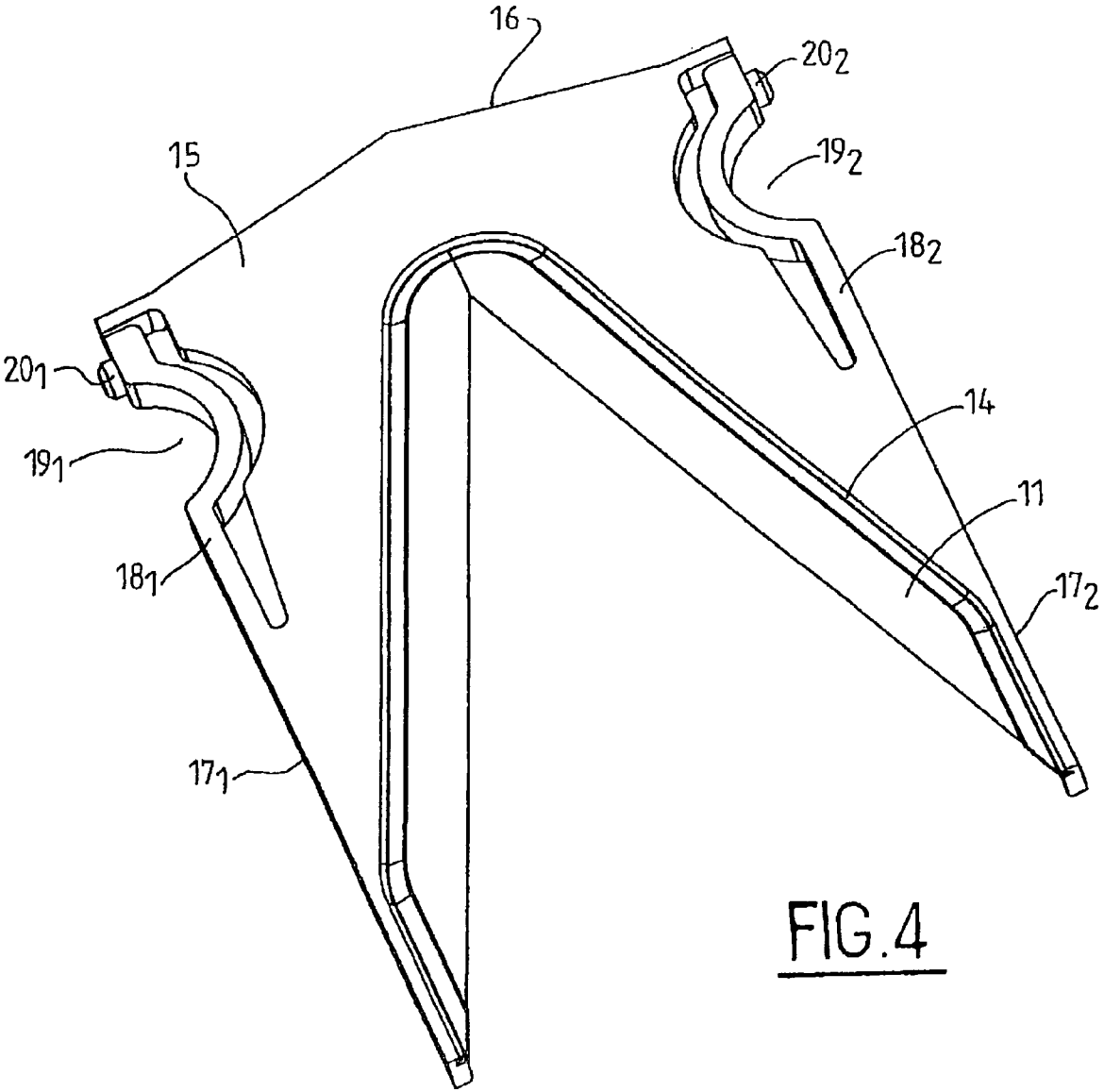
Figure 5:
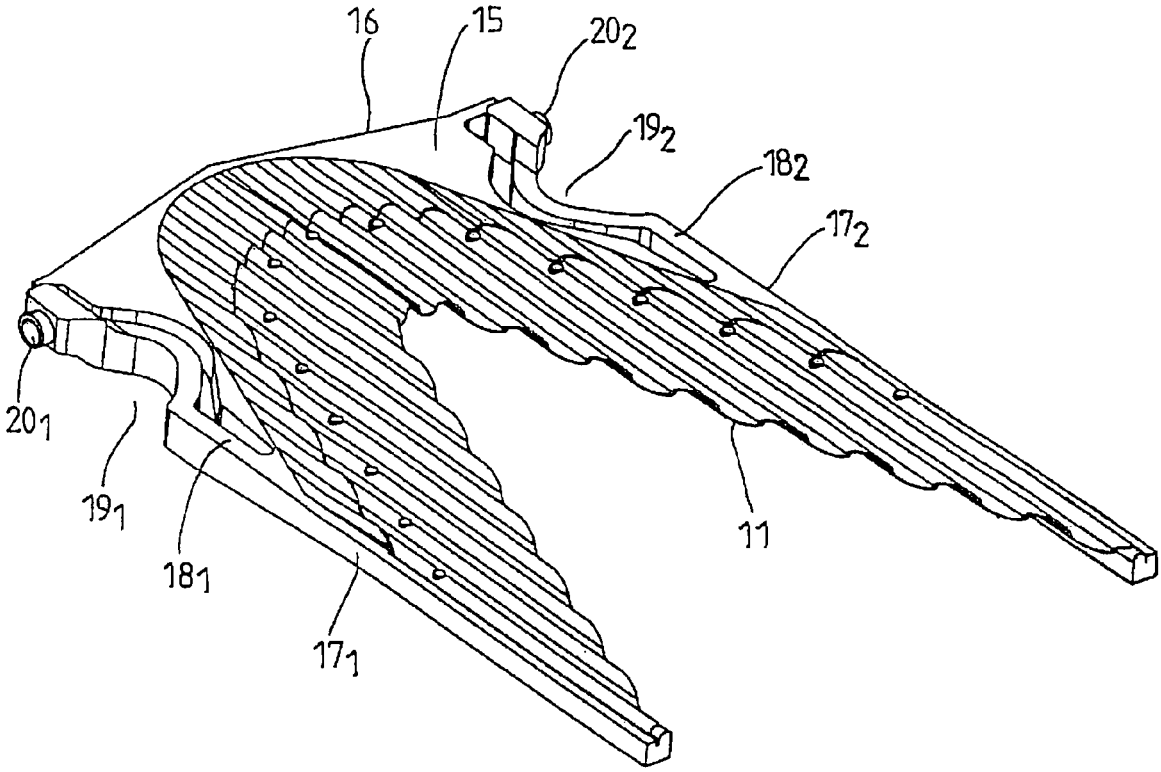
Figure 6:
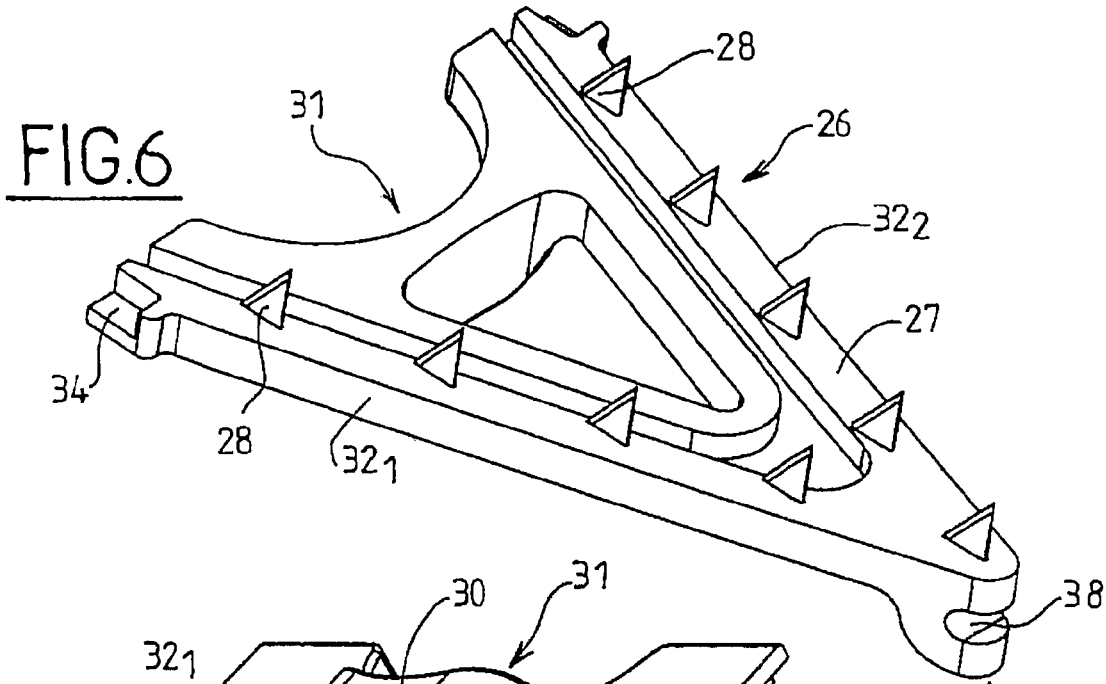
Figure 7:
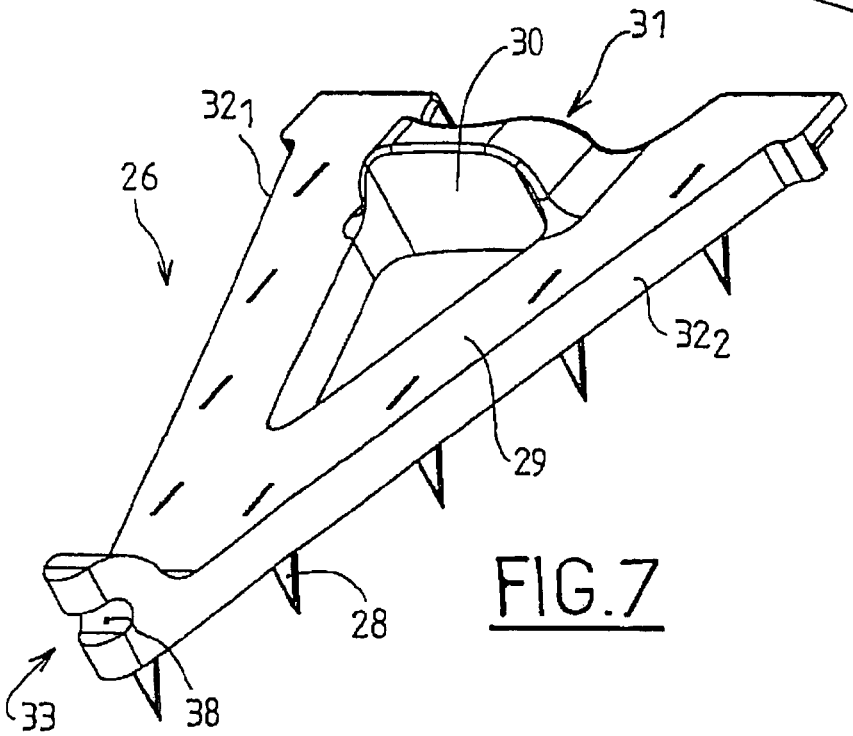

FIG. 1 is a perspective view showing the upper face of the vegetable cutter, FIG. 2 is a perspective view which corresponds to FIG. 1 but in which the carriage has been disassembled and is shown as an "exploded view", FIG. 3 is a perspective view showing the lower face of the vegetable cutter, FIG. 4 is a perspective view of a disc-cutting cartridge, FIG. 5 is a perspective view of a variant of the disc-cutting cartridge, FIG. 6 is a perspective view showing the active face of a julienne type cutting cartridge, FIG. 7 is a perspective view corresponding to FIG. 6 but showing the opposite face of the julienne cartridge.

DETAILED DESCRIPTION OF THE DRAWINGS

According to FIGS. 1 and 2, the vegetable cutter is substantially constituted by a frame 1 which is supported on two feet which can be folded back, that is to say, a front foot $\mathbf{2}_1$ and a rear foot $\mathbf{2}_2$.

The frame 1 comprises two parallel longitudinal uprights $\mathbf{3}_1$, $\mathbf{3}_2$, as well as a plate 4 which is mounted so as to be moveable in translation between these uprights in order to allow the cutting width to be adjusted.

The configuration of the plate 4 for adjusting the cutting width, which is shown in greater detail in FIG. 3, as well as that of the elements which allow it to be displaced between the uprights $\mathbf{3}_1$, $\mathbf{3}_2$, correspond to those described in document FR 2 825 043 and will not be set out in this instance for reasons of brevity.

According to FIG. 3, the frame 1 is provided with a crank 25 which co-operates with the plate 4 for adjusting the cutting width in order to allow a micrometric adjustment of this width.

According to FIGS. 1 and 2, the two parallel uprights $\mathbf{3}_1$, $\mathbf{3}_2$ define, at the upper portion thereof, two guiding rails for a carriage 5 which can be moved back and forth in translation along the guiding rails.

According to FIG. 2, the carriage 5 is constituted by the association of a guide chamber 6 and a push-button 7 which fits thereon.

The guide chamber 6 is constituted by a cylindrical element which is open at the upper portion thereof so as to delimit a receiving space for the vegetables to be cut and which is provided, at the lower portion thereof, with a substantially rectangular collar 8 whose two opposing edges 9 are folded down in order to define two grooves 10 which co-operate with the guiding rails $\mathbf{3}_1$, $\mathbf{3}_2$.

The configuration of the push-button 7 also corresponds to that of the push-button with which the vegetable cutter is provided which is described in document FR 2 825 043.

This push-button 7 is intended to be gripped manually by the user in order to move the carriage 5 along the guiding rails with a pressure being applied continuously to the vegetables contained in the guide chamber 6 in order to press them against a V-shaped cutting blade 11.

This blade 11 is mounted transversely between the longitudinal uprights $\mathbf{3}_1$, $\mathbf{3}_2$ facing a first edge 12 of the plate 4 for adjusting the cutting width in order to define an aperture 13 for the passage of the cut vegetables, which aperture is also in the shape of a "V".

More precisely, and according to FIG. 4, the cutting blade 11 is a flat blade which is mounted on a first edge 14 of a disc-cutting cartridge 15 which is substantially flat and which is intended to be inserted longitudinally between the uprights $\mathbf{3}_1$, $\mathbf{3}_2$ of the frame 1 in the position shown in FIGS. 1 and 2.

According to FIGS. 1, 2 and 5, the disc-cutting cartridge 15 is provided with a V-shaped cutting blade 11 which is not flat but instead which is corrugated in order to allow corrugated or crinkled discs to be produced.

Of course, the vegetable cutter is generally provided with not just one, but a series of disc-cutting cartridges which have blades of different shapes in order to allow different types of disc to be produced.

According to FIGS. 4 and 5, the disc-cutting cartridge 15 comprises a second edge 16 opposite the first edge 14, on which the cutting blade 11 is mounted, as well as two lateral edges $\mathbf{17}_1$, $\mathbf{17}_2$ which are provided, close to the second edge 16, with resiliently deformable hooks $\mathbf{18}_1$, $\mathbf{18}_2$ which are provided, on the one hand, with gripping notches $\mathbf{19}_1$ and $\mathbf{19}_2$ and, on the other hand, at the free end thereof, with two retaining studs $\mathbf{20}_1$, $\mathbf{20}_2$ which are intended to snap into holes 21 which have been drilled for this purpose in the uprights $\mathbf{3}_1$, $\mathbf{3}_2$ of the frame 1 which are shown in FIGS. 1 and 2.

According to FIGS. 1 and 2, the uprights $\mathbf{3}_1$, $\mathbf{3}_2$ of the frame 1 are also provided with finger holes 22 which are located facing the gripping notches $\mathbf{19}_1$, $\mathbf{19}_2$ when the disc-cutting cartridge 15 is positioned in the central portion of the frame 1.

In order to allow this positioning, the frame 1 is further provided with two pairs of longitudinal lugs 23, 23' which are located facing each other on the inner face of each respective upright $\mathbf{3}_1$, $\mathbf{3}_2$ in order to define guiding slides of the lateral edges $\mathbf{17}_1$, $\mathbf{17}_2$ of the disc-cutting cartridge 16 close to the first edge 14 thereof which is provided with the cutting blade 11.

These longitudinal positioning lugs 23, 23' co-operate, respectively, with a pair of transverse lugs 24 which form a stop for this first edge 14 of the disc-cutting cartridge 15.

In order to position the cartridge 15, the user must grip the cartridge by the gripping notches $\mathbf{19}_1$, $\mathbf{19}_2$, then introduce the lateral edges $\mathbf{17}_1$, $\mathbf{17}_2$ thereof into the slides defined by the positioning lugs 23, 23' until it comes into abutment with the transverse lugs 24.

When these elements are brought into abutment, the retaining studs $\mathbf{20}_1$, $\mathbf{20}_2$ with which the resiliently deformable hooks $\mathbf{18}_1$, $\mathbf{18}_2$ are provided automatically snap into the holes 21 drilled in the uprights $\mathbf{3}_1$, $\mathbf{3}_2$ of the frame 1.

According to FIGS. 1 and 2, the configuration of the feet $\mathbf{2}_1$, $\mathbf{2}_2$ which can be folded back is selected so as to allow the user to handle the vegetable cutter in a straight position but also in a position in which the plate 4 for adjusting the cutting width and the disc-cutting cartridge 15 are inclined at an angle of approximately 45° relative to the longitudinal axis of the frame 1, which position is found to be more practical for use.

During this operation, the user may press on an ergonomic handle 41 which is fixed to the elements for adjusting the cutting width.

According to FIGS. 1 and 2, the front foot $\mathbf{2}_1$ has a symmetrical shape, whilst the rear foot $\mathbf{2}_2$ is asymmetric.

The rear foot $\mathbf{2}_2$ is introduced with force in holes 42 which are provided for this purpose in the lateral uprights $\mathbf{2}_1$, $\mathbf{2}_2$ of the frame 1 in order to allow this foot to be mounted in one direction or another so that the vegetable cutter can be operated by either a right-handed or a left-handed user.

According to FIGS. 3, 6 and 7, the vegetable cutter is further provided with a removable baton-cutting cartridge or julienne cartridge 26, which is also intended to be inserted longitudinally between the uprights $\mathbf{3}_1$, $\mathbf{3}_2$ of the frame 1 below the disc-cutting cartridge 15 in the position shown in FIG. 3.

According to FIGS. 6 and 7, this julienne cartridge 26 is constituted by a substantially triangular element which is hollowed out in the central portion thereof and which comprises, on the one hand, an active face 27 which is illustrated in FIG. 6 and which is provided with a series of longitudinal-cutting blades 28 which are directed transversely and which are intended to be positioned facing the disc-cutting cartridge 15 and, on the other hand, a gripping face 29 which is illustrated in FIG. 7 and which is located facing the active face 27 and which is provided with a positioning tongue 30.

These two faces 27, 29 are delimited by a first edge 31 which comprises a curved recess and by two lateral edges $\mathbf{32}_1$, $\mathbf{32}_2$ which are separated by a positioning peak 33.

When the julienne cartridge 26 is positioned in the central portion of the frame 1 in the position shown in FIG. 3, the first edge 31 thereof is located facing the first edge 14 of the plate 15 for adjusting the cutting width.

The active face 27 of the julienne cartridge 26 is provided, in the region of this first edge 31, with two shoulders 34 which are intended to co-operate with two plates which form a stop 35 and which are mounted for this purpose between the uprights $\mathbf{3}_1$, $\mathbf{3}_2$ of the frame 1, as shown in FIG. 3.

A slide 36 which can be moved in translation in apertures 37 of the uprights $\mathbf{3}_1$, $\mathbf{3}_2$ allows the julienne cartridge to be locked in this position.

According to FIGS. 6 and 7, the julienne cartridge 26 is further provided, at the edge thereof, in the region of the positioning peak 33, with a positioning recess 38.

According to FIG. 3, when the julienne cartridge 26 is positioned in the central portion of the frame 1, the recess 38 is inserted in a central shoulder 39 of a transverse centering bar 40 which separates the two uprights $\mathbf{3}_1$, $\mathbf{3}_2$ of the frame 1.

The positioning of the julienne cartridge 26 is as simple and rapid as that of the disc-cutting cartridge 15.

After the frame 1 has been turned over, the user must grip this cartridge 26 by the positioning tongue 30, then introduce the recess 38 in the shoulder 39 of the centering bar 40 and bring the shoulders 34 into contact with the plates 35; the slide 36 then simply has to be displaced in translation in the apertures 37 of the uprights $\mathbf{3}_1$, $\mathbf{3}_2$ so that it overlaps the face 29 of the julienne cartridge 26 and locks it in position.

The invention claimed is:

1. A manual safety vegetable cutter comprising:

a frame which is supported on feet, and which is provided with two parallel longitudinal uprights which define two guiding rails and which delimit, at an inner portion thereof, a space for receiving vegetables to be cut, said guiding rails being connected by an adjusting plate which is mounted so as to be moveable in translation between the uprights, perpendicularly to a displacement axis of the vegetables to be cut in order to allow a cutting thickness to be adjusted, at least one cutting blade which is mounted transversely between the longitudinal uprights facing an edge or first edge of the adjusting plate in order to define an aperture for the passage of the cut vegetables, and at least one disc-cutting cartridge comprising a substantially flat removable element which is adapted to be inserted longitudinally between the frame uprights and which comprises a first edge on which the cutting blade is mounted, a second edge facing the first edge, and two lateral edges, the disc-cutting cartridge being provided with gripping means which co-operate with positioning means which are provided on the frame, wherein the gripping means comprise elements in a region of the second edge of the disc-cutting cartridge for retaining the disc-cutting cartridge, wherein the elements for retaining the disc-cutting cartridge comprise two resiliently deformable hooks which are located facing each other on the respective lateral edges of the disc-cutting cartridge and which are each provided with a retaining stud which is adapted to be snapped into holes in the uprights of the frame, and wherein the gripping means comprise two safety notches which are located facing each other on the respective lateral edges of the disc-cutting cartridge close to the second edge of the disc-cutting cartridge and by which the cartridge is gripped when positioning the cartridge and wherein the positioning means comprise at least two pairs of longitudinal lugs which are located facing each other on an inner face of each respective upright in order to define guiding slides for the lateral edges of the disc-cutting cartridge, close to the first edge of the disc-cutting cartridge which is provided with the cutting blade, and which cooperate with a pair of transverse lugs which form a stop for the first edge, wherein the longitudinal lugs are between the transverse lugs and the second edge of the disc-cutting cartridge, and wherein inserting the disc-cutting cartridge longitudinally comprises inserting the disc-cutting cartridge between the two pairs of longitudinal lugs in a direction towards the transverse lugs.

2. The vegetable cutter according to claim 1, wherein the safety notches cooperate with finger holes in the uprights of the frame.

3. The vegetable cutter according to claim 1, wherein the cutting blade mounted on the first edge of the disc-cutting cartridge is a V-shaped blade.

4. The vegetable cutter according to claim 3, wherein the cutting blade is a corrugated blade.

5. The vegetable cutter according to claim 1, comprising at least one removable baton-cutting cartridge or julienne cartridge which is adapted to be inserted longitudinally between the frame uprights below the disc-cutting cartridge, wherein said removable cartridge comprises an active face which is provided with a series of longitudinal-cutting blades which are directed transversely and which are adapted to be positioned facing the disc-cutting cartridge.

6. The vegetable cutter according to claim 5, wherein the julienne cartridge is provided with a positioning tongue.

7. The vegetable cutter according to claim 1, wherein the feet of the frame have a shape which allows the adjusting plate and the cutting cartridge to be inclined about the longitudinal axis thereof.

8. The vegetable cutter according to claim 7, which has a longitudinal centerplane, and wherein the feet comprise sections inclined to the centerplane, on at least one side of the centerplane, on which the vegetable cutter can rest in the inclined position.

9. The vegetable cutter according to claim 1, further comprising a crank for micrometric adjustment of the cutting thickness.

10. The vegetable cutter according to claim 1, further comprising a carriage comprising:

a cylindrical guide chamber which is open at an upper portion thereof and which is provided, at a lower portion thereof, with a substantially rectangular collar, two of the opposing edges of which are folded down in order to define two grooves which co-operate with the guiding rails, and a push-button which fits on or in the guide chamber and which is intended to be gripped manually by a user in order to move the carriage along the guiding rails with a pressure being applied continuously to the vegetables contained in the receiving space in order to press the vegetables against the cutting blade and allow the vegetables to be cut by the blade.

11. A manual safety vegetable cutter comprising:

a frame supported on feet and comprising two parallel uprights, wherein the uprights form two longitudinal guiding rails defining between them a space for receiving vegetables to be cut;

at least one slicing cartridge provided with grippers that co-operate with locaters on the frame and comprising a substantially flat removable element that can be inserted longitudinally between the frame uprights and that comprises a first edge on which a cutting blade is mounted, a second edge facing the first edge, and two lateral edges; and an adjusting plate mounted transversely between the longitudinal uprights and having a first edge facing the first edge of the slicing cartridge to define an aperture for the passage of cut vegetables, the first edges being relatively movable in translation between the uprights perpendicularly to the longitudinal direction of the guiding rails to allow a cutting thickness of the cut vegetables to be adjusted, wherein the grippers comprise elements for retaining the slicing cartridge, and are provided close to the second edge of the slicing cartridge, wherein the elements for retaining the slicing cartridge comprise two resiliently deformable hooks located facing each other on the respective lateral edges of the slicing cartridge and provided with retaining studs that can be snapped into holes in the uprights of the frame, wherein the grippers comprise two safety notches located facing each other on the respective lateral edges of the slicing cartridge close to the second edge of the slicing cartridge, and wherein the locaters comprise at least two pairs of longitudinal lugs that are located facing each other on an inner face of each respective upright and define guiding slides for the lateral edges of the slicing cartridge close to the first edge of the slicing cartridge, and that co-operate with a pair of transverse lugs that form a stop for the first edge, wherein the longitudinal lugs are between the transverse lugs and the second edge of the disc-cutting cartridge, and wherein inserting the disc-cutting cartridge longitudinally comprises inserting the disc-cutting cartridge between the two pairs of longitudinal lugs in a direction towards the transverse lugs.

12. The vegetable cutter according to claim 11, wherein finger holes in the uprights of the frame co-operate with the safety notches to permit fingers of a user to grip the slicing cartridge at the safety notches.

13. The vegetable cutter according to claim 11, further comprising at least one removable baton-cutting cartridge or julienne cartridge that comprises an active face provided with a series of transversely-directed longitudinal-cutting blades, and wherein the julienne cartridge can be inserted longitudinally between the frame uprights below the slicing cartridge with the longitudinal-cutting blades facing the slicing cartridge.

14. The vegetable cutter according to claim 11, further comprising a crank for precise adjustment of the cutting thickness.

15. The vegetable cutter according to claim 11, further comprising a carriage comprising:

a guide chamber open at an upper portion thereof, and a push-button that fits on or in the guide chamber and is arranged to be gripped manually by a user to move the carriage along the guiding rails with a pressure being applied continuously to the vegetables contained in the receiving space to press the vegetables against the cutting blade and allow the vegetables to be cut by the blade.

16. A manual safety vegetable cutter comprising:

a frame comprising two parallel uprights, wherein the uprights form two longitudinal guiding rails defining between them a space for receiving vegetables to be cut;

at least one slicing cartridge provided with grippers that co-operate with locaters on the frame and comprising a substantially flat removable element that can be inserted longitudinally between the frame uprights and that comprises a first edge on which a cutting blade is mounted, a second edge facing the first edge, and two lateral edges; and a plate mounted transversely between the longitudinal uprights and having a first edge facing the first edge of the slicing cartridge to define an aperture for the passage of cut vegetables, wherein the grippers comprise elements for retaining the slicing cartridge, and are provided close to the second edge of the slicing cartridge, wherein the elements for retaining the slicing cartridge comprise two resiliently deformable hooks located facing each other on the respective lateral edges of the slicing cartridge and provided with retaining studs that can be snapped into holes in the uprights of the frame, wherein the grippers comprise two safety notches located facing each other on the respective lateral edges of the slicing cartridge close to the second edge of the slicing cartridge, and wherein the locaters comprise at least two pairs of longitudinal lugs that are located facing each other on an inner face of each respective upright and define guiding slides for the lateral edges of the slicing cartridge close to the first edge of the slicing cartridge, and that co-operate with a pair of transverse lugs that form a stop for the first edge, wherein the longitudinal lugs are spaced from the transverse lugs towards the second edge of the disc-cutting cartridge, and wherein inserting the disc-cutting cartridge longitudinally comprises inserting the disc-cutting cartridge longitudinally between the two pairs of longitudinal lugs in a direction towards the first edge.

17. A manual safety vegetable cutter comprising:

a frame which is supported on feet, and which is provided with two parallel longitudinal uprights which define two guiding rails and which delimit, at an inner portion thereof, a space for receiving vegetables to be cut, said guiding rails being connected by an adjusting plate which is mounted so as to be moveable in translation between the uprights, perpendicularly to a displacement axis of the vegetables to be cut in order to allow a cutting thickness to be adjusted, at least one cutting blade which is mounted transversely between the longitudinal uprights facing an edge or first edge of the adjusting plate in order to define an aperture for the passage of the cut vegetables, and at least one disc-cutting cartridge comprising a substantially flat removable element which is adapted to be inserted longitudinally between the frame uprights and which comprises a first edge on which the cutting blade is mounted, a second edge facing the first edge, and two lateral edges, the disc-cutting cartridge being provided with gripping means which co-operate with positioning means which are provided on the frame, wherein the gripping means comprise elements in a region of the second edge of the disc-cutting cartridge for retaining the disc-cutting cartridge, wherein the elements for retaining the disc-cutting cartridge comprise two resiliently deformable hooks which are located facing each other on the respective lateral edges of the disc-cutting cartridge and which are each provided with a retaining stud which is adapted to be snapped into holes in the uprights of the frame, and wherein the gripping means comprise two safety notches which are located facing each other on the respective lateral edges of the disc-cutting cartridge close to the second edge of the disc-cutting cartridge and by which the cartridge is gripped when positioning the cartridge, comprising at least one removable baton-cutting cartridge or julienne cartridge which is adapted to be inserted longitudinally between the frame uprights below the disc-cutting cartridge, wherein said removable cartridge comprises an active face which is provided with a series of longitudinal-cutting blades which are directed transversely and which are adapted to be positioned facing the disc-cutting cartridge, wherein the julienne cartridge comprises a substantially triangular element which comprises a first edge which is located facing the first edge of the adjusting plate and which is adapted to abut plates which are mounted for this purpose between the frame uprights and to be locked in position by a slide which can be moved in apertures of the frame uprights, and two lateral edges which are separated by a positioning peak which is provided, in the region of the edge thereof, with a recess which is adapted to be inserted in a central shoulder of a transverse centering bar which separates the two frame uprights.

* * * * *